US006412673B1

(12) United States Patent
Chuang

(10) Patent No.: US 6,412,673 B1
(45) Date of Patent: Jul. 2, 2002

(54) NECKTIE-SETTING CLIP

(76) Inventor: Yi Chang Chuang, Taipei (TW)

( * ) Notice: Subject to any disclaimer, the term of this patent is extended or adjusted under 35 U.S.C. 154(b) by 0 days.

(21) Appl. No.: 09/900,120

(22) Filed: Jul. 6, 2001

(51) Int. Cl.[7] ..... D06C 15/00
(52) U.S. Cl. ..... 223/82; 223/81
(58) Field of Search ..... 223/81, 82, 83, 223/84, 1; 2/144; 24/49.1

(56) References Cited

U.S. PATENT DOCUMENTS 2,208,695 A * 7/1940 Fallon ..... 223/81
3,964,105 A * 6/1976 Gideon ..... 223/81
6,149,207 A * 11/2000 Bradford, Jr. ..... 223/82

* cited by examiner

*Primary Examiner*—Bibhu Mohanty
(74) *Attorney, Agent, or Firm*—W. Wayne Liauh

(57) ABSTRACT

A necktie-setting clip includes an inverted triangular front shell defining a wide and flat top opening and a narrow and deep bottom opening for a necktie to extend through the top and the bottom openings to locate behind the front shell. A pressing member is pivotally connected to a rear side of the front shell. When the pressing member is turned to a horizontal position perpendicular to the front shell, the necktie-setting clip could be adjusted to a desired position on the necktie, and when the pressing member is turned to a downward vertical position parallel to the front shell, the necktie-setting clip presses the necktie against the front shell. The necktie-setting clip replaces a conventional tie knot and makes the setting of the necktie around the user's neck easily, and may serve as an ornament on the necktie.

4 Claims, 7 Drawing Sheets

NECKTIE-SETTING CLIP

BACKGROUND OF THE INVENTION

The present invention relates to a necktie-setting clip for quickly setting a necktie around a user's neck without the need of tying a knot on the necktie.

A necktie is an important part in the suit of man in formal occasions. The necktie is usually a long strip fixed around the user's neck with a knot tied immediately below a front center of the shirt collar. The tie knot must have symmetrical and balanced shape to present a beautiful appearance.

The tie knot is not easily perfectly formed for most users. An ugly tie knot would largely spoil an entire appearance of the user. The user might feel frustrated when he fails to tie a knot. A solution in early stage to the complicate tie knot is to ask someone else to tie the knot for the user, and the knot is kept on the necktie for use next time. The necktie with a knot tied thereon for a prolonged time tends to become wrinkled and lose its beautiful appearance. There is also a simple type of necktie available in the market. The simple-type necktie includes a fixed knot that is not loosened from the necktie, and a neckband that does not require adjustment in length and could be quickly enclosed around the user's neck below the shirt collar. This simple-type necktie has a shape different from that of a conventional necktie. It makes the tie knot an easy and quick thing, it does not, however, solve the problem of difficulty in tying the knot on a conventional long strip of necktie.

SUMMARY OF THE INVENTION

A primary object of the present invention is to provide a necktie-setting clip that serves as a knot on a necktie to save the complicate procedures of forming a tie knot.

Another object of the present invention is to provide a necktie-setting clip that serves as an ornament on a necktie while fixing the necktie in place.

To achieve the above and other objects, the necktie-setting clip of the present invention mainly includes an inverted triangular front shell having a configuration similar to a perfect tie knot. The front shell defines a wide and flat top opening and a narrow and deep bottom opening for a necktie to extend through the top and the bottom openings to locate behind the front shell. A pressing member is pivotally connected to a rear side of the front shell for pressing the necktie against the front shell. The pressing member has an end in the form of a squared pivot shaft being up and down turnably received in a shaft behind the front shell. A push member in the shaft of the front shell is pushed by an elastic member to firmly press against the squared pivot shaft, so that the pressing member could be located in place in parallel with or perpendicular to the front shell. When the pressing member is in parallel with the front shell, it presses the necktie against the front shell.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
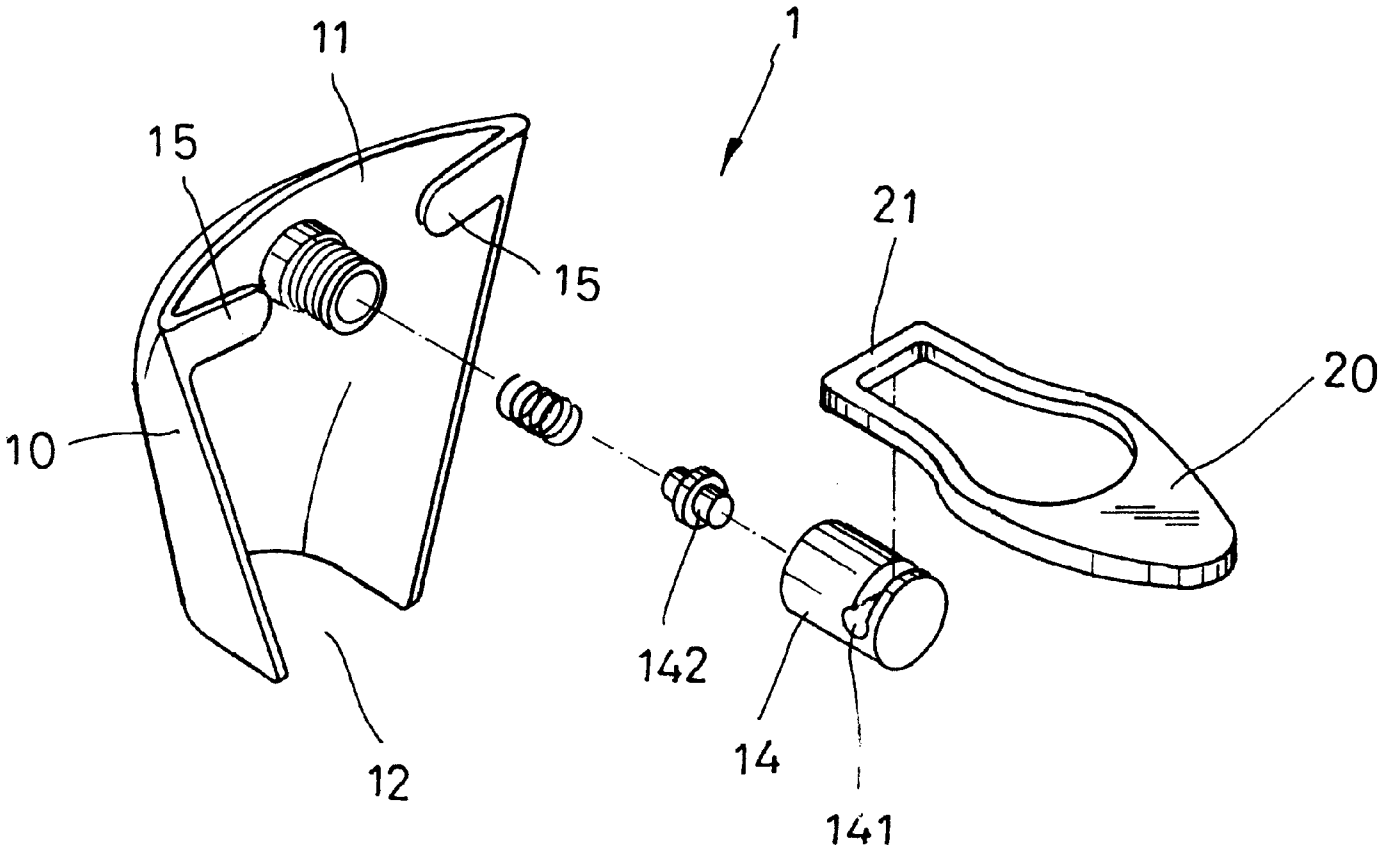
FIG. 1 is an exploded perspective view of a necktie-setting clip according to a first embodiment of the present invention.
Figure 2:
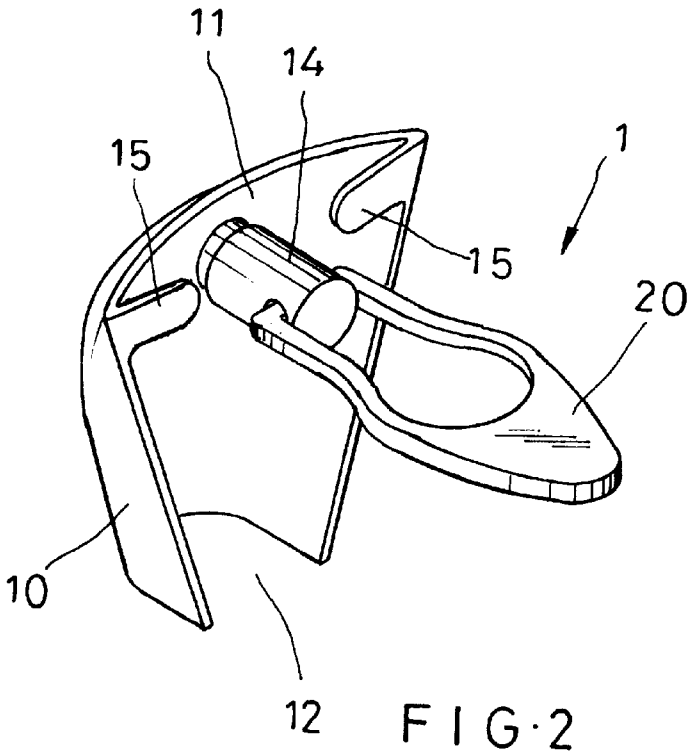
FIG. 2 is an assembled perspective view of the necktie-setting clip of FIG. 1.
Figure 4:
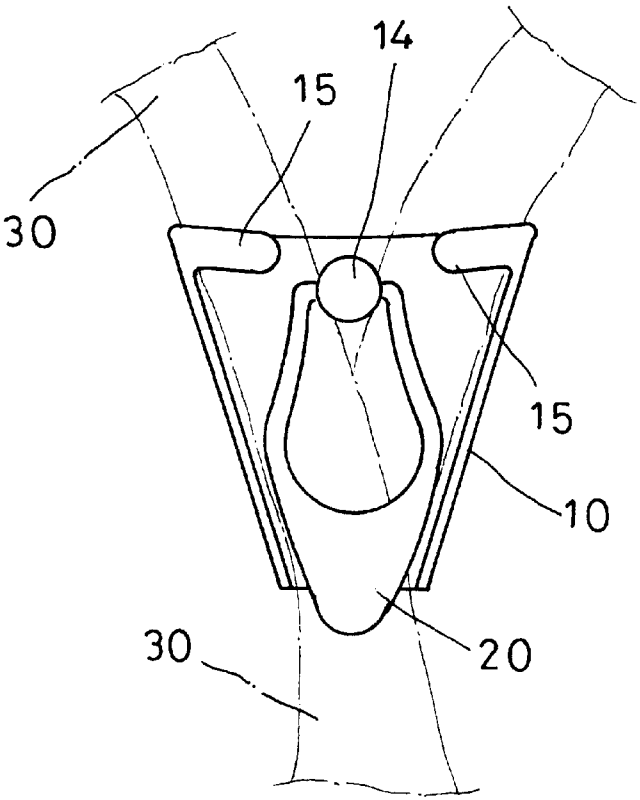
FIG. 4 shows the manner in which the necktie-setting clip of FIG. 1 holds a necktie in place.

Please refer to FIGS. 1 and 2 that are exploded and assembled perspective views, respectively, of a necktie-setting clip 1 according to a first embodiment of the present invention. As shown, the necktie-setting clip 1 mainly includes a front shell 10 and a pressing member 20.

The front shell 10 is an open-backed member substantially in the form of an inverted triangle to define a wide and flat top opening 11 and a narrow and deep bottom opening 12. Please also refer to FIG. 3 that is an enlarged sectioned side view of the necktie-setting clip of FIG. 1. A cap 14 having a transverse slot 141 provided at a top thereof is screwed to a hollow cylinder rearward projected from a backside of the front shell 10. A push member 142 is mounted in the hollow cylinder and pushed by an elastic member to project a front end into the slot 141 of the cap 14.

Figure 3:
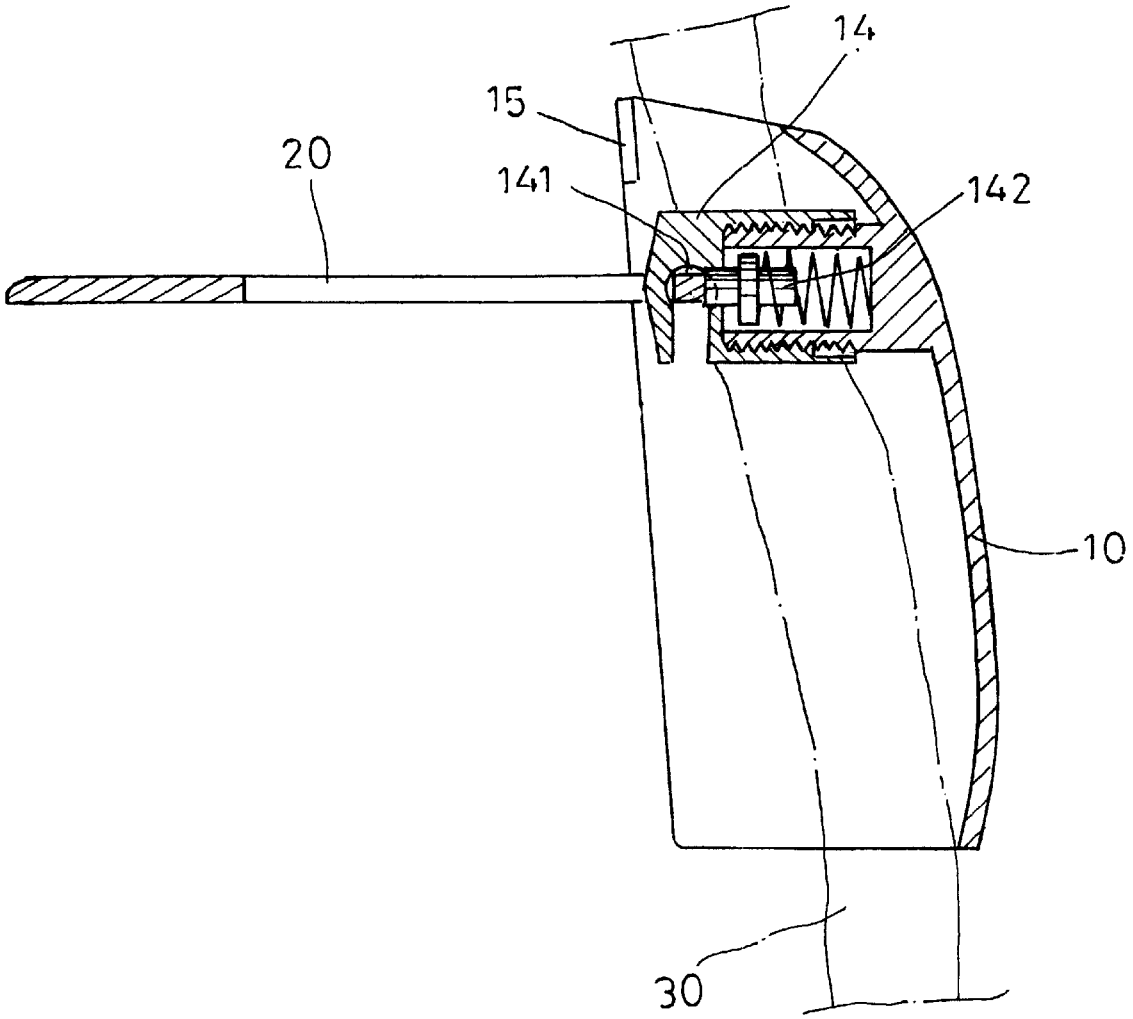
FIG. 3 is an enlarged and sectioned side view of the necktie-setting clip of FIG. 1.

The pressing member 20 may be a flat frame or plate having an end forming a squared pivot shaft 21. The squared pivot shaft 21 is received in the transverse slot 141 of the cap 14, such that the pressing member 20 is upward and downward movable about the squared pivot shaft 21 in the slot 141. When the squared pivot shaft 12 is located in the slot 141 in a position perpendicularly to the front shell 10, the front end of the push member 142 projected into the slot 141 is pushed by the elastic member to tightly press against a flat rear end surface of the squared pivot shaft 12, as shown in FIGS. 2 and 3, and thereby holds the pressing member 20 in a horizontal position generally perpendicular to the front shell 10. When the pressing member 20 is downward pivotally turned about the squared pivot shaft 21 by 90 degrees, it is moved to a vertical position generally in parallel with the front shell 10 and held in place by the push member 142 that is now elastically pressing against a flat bottom surface of the square pivot shaft 21.

When using the necktie-setting clip 1 of the present invention to set a necktie 30 around a user's neck, first downward extend two ends of the necktie 30 through the wide and flat top opening 11 and the narrow and deep bottom opening 12 behind the front shell 10, as shown in FIG. 3, so that one of the two ends that is wider and forms a front apron of the necktie 30 is directly located behind the front shell 10, and the other end that is narrower and forms a rear apron of the necktie 30 is located behind the front apron. The front and the rear aprons should be adjusted to have a height difference between their lower ends. The height difference must be slightly larger than twice of a distance between a current position of the necktie-setting clip 1 and a shirt collar 31. Thereafter, the pressing member 20 is pivotally turned downward about the pivot shaft 21, so as to press the necktie 30 against a backside of the front shell 10, as shown in FIG.

Figure 5:
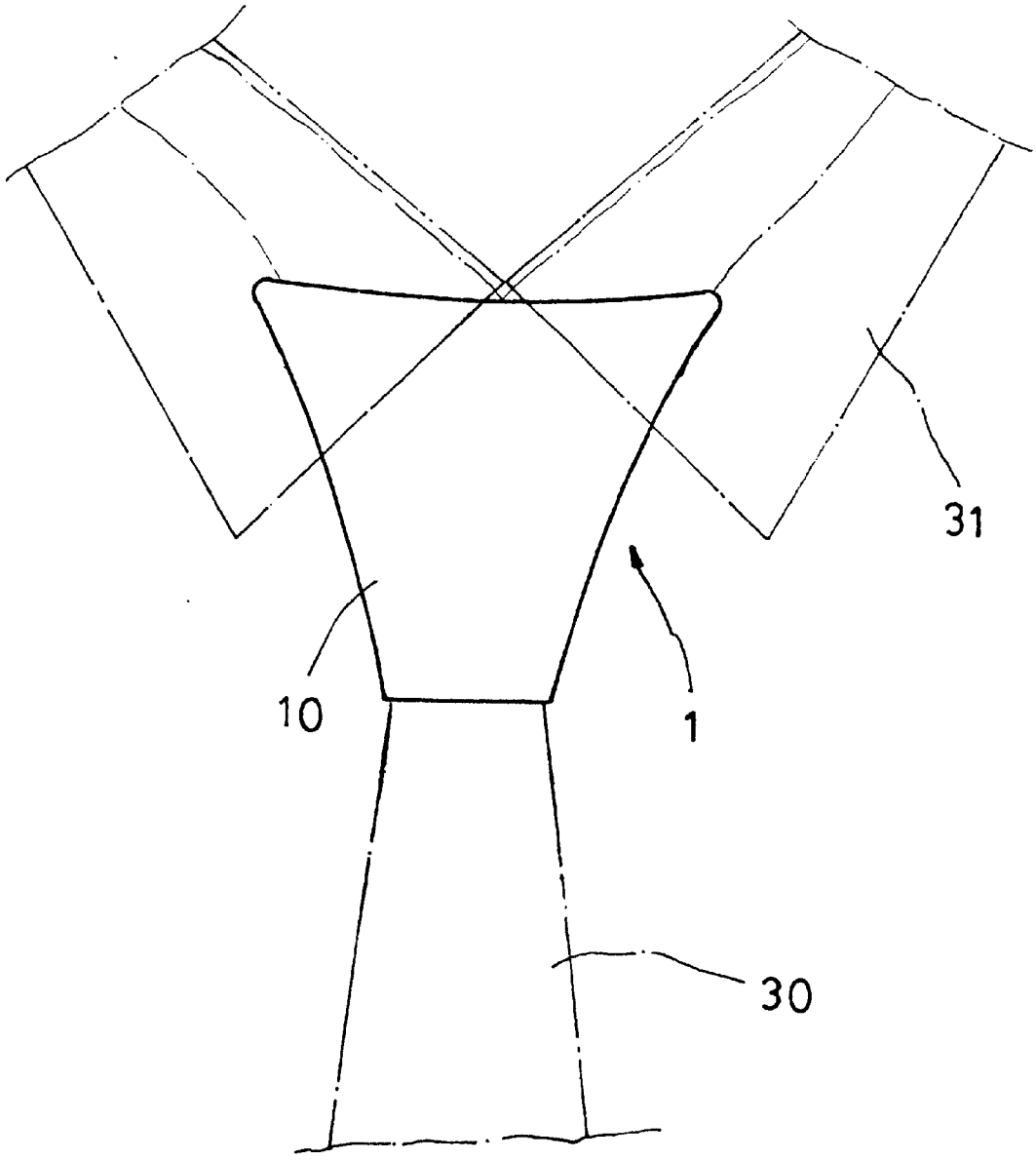
FIG. 5 shows the use of the necktie-setting clip of FIG. 1 to fix the necktie around a user's neck.

4. The user may now pull the rear apron of the necktie 30 downward while moves the necktie-setting clip 1 upward to locate immediately below the shirt collar 31, as shown in FIG. 5. At this point, the necktie 30 is fitly set around the user's neck.

To release the necktie 30 from the user's neck, simply slightly turn the pressing member 20 upward to reduce a pressure applied on the necktie 30 by the pressing member 20, allowing the whole necktie-setting clip 1 to slide downward to a height to facilitate a full turning of the pressing member 20 to the horizontal position perpendicular to the front shell 10. The necktie-setting clip 1 could then be easily pulled off the necktie 30.

The front shell 10 has a configuration generally similar to a Windsor knot tied on the necktie 30, and is therefore suitable for replace the Windsor knot. Since the front shell 10 is formed into a perfect shape, it allows the necktie 30 to be fixed around the user's neck just as having a perfect knot below the shirt collar 31.

The pressing member 20 mainly serves to press the front and the rear aprons of the necktie 30 against the front shell 10 and to fix the whole necktie-setting clip 1 on the necktie 30 without easily sliding up or down.

Figure 6:
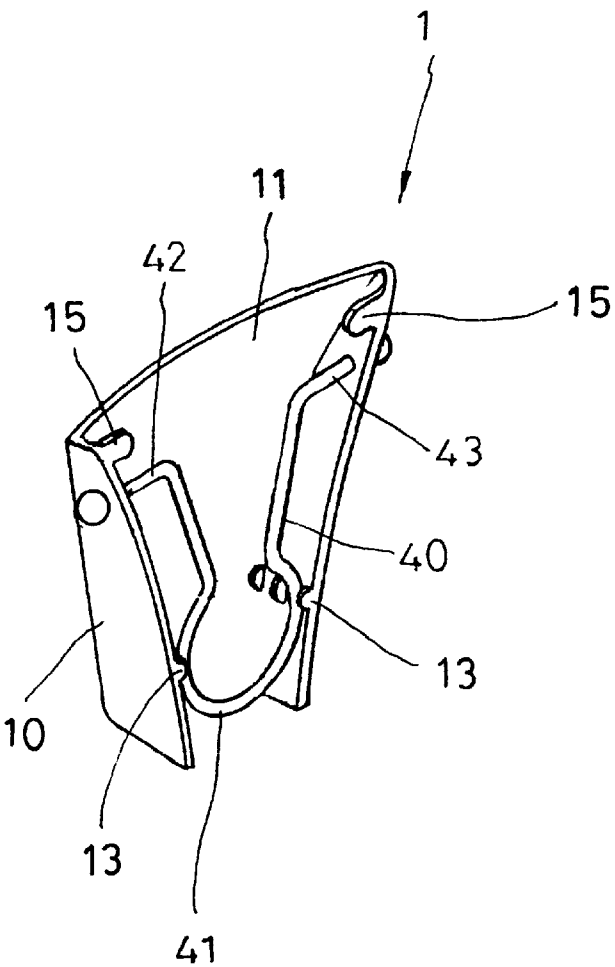
FIG. 6 is an assembled perspective view of a necktie-setting clip according to a second embodiment of the present invention.
Figure 7:
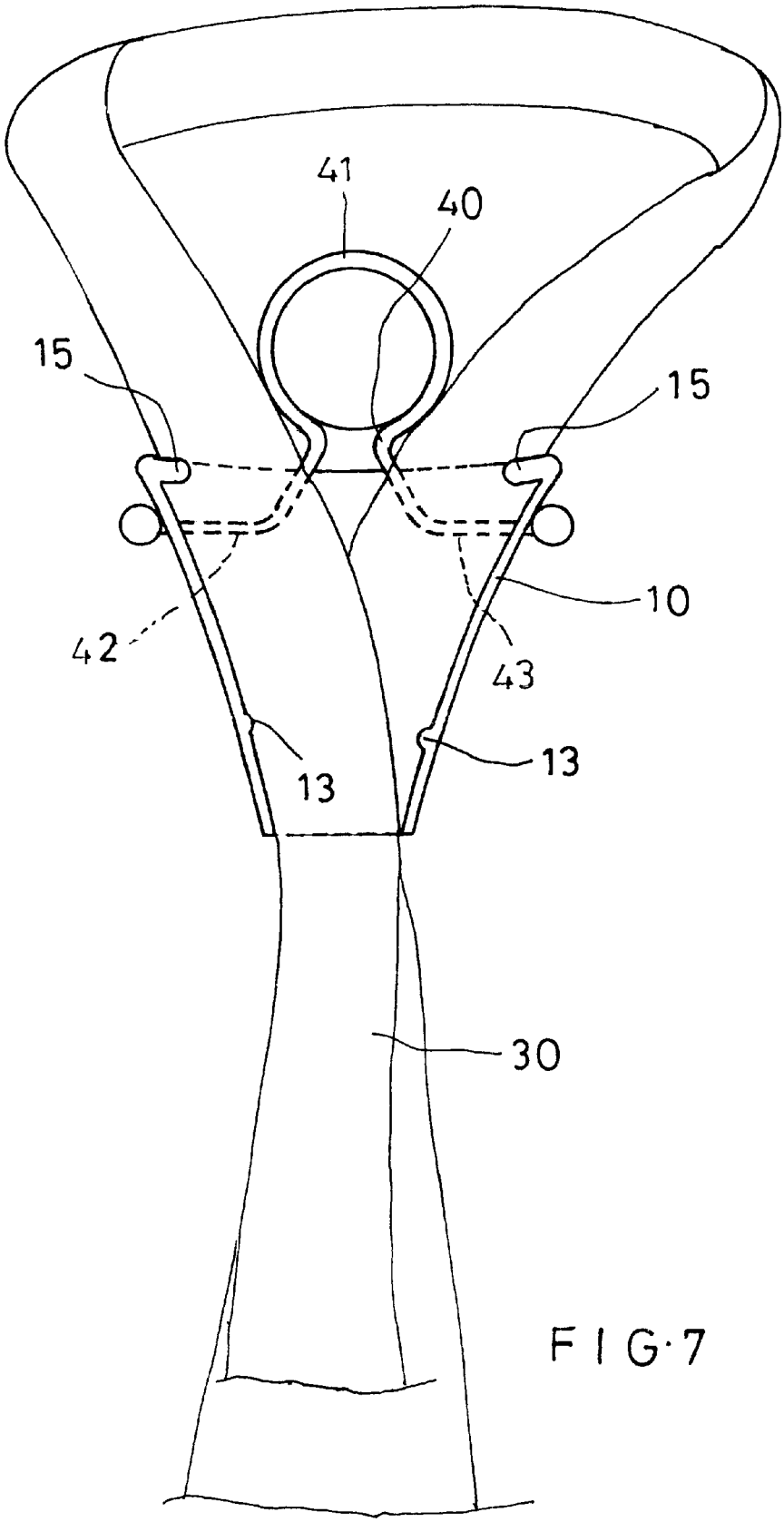
FIG. 7 shows the manner in which the necktie-setting clip of FIG. 6 holds a necktie in place.
Figure 8:
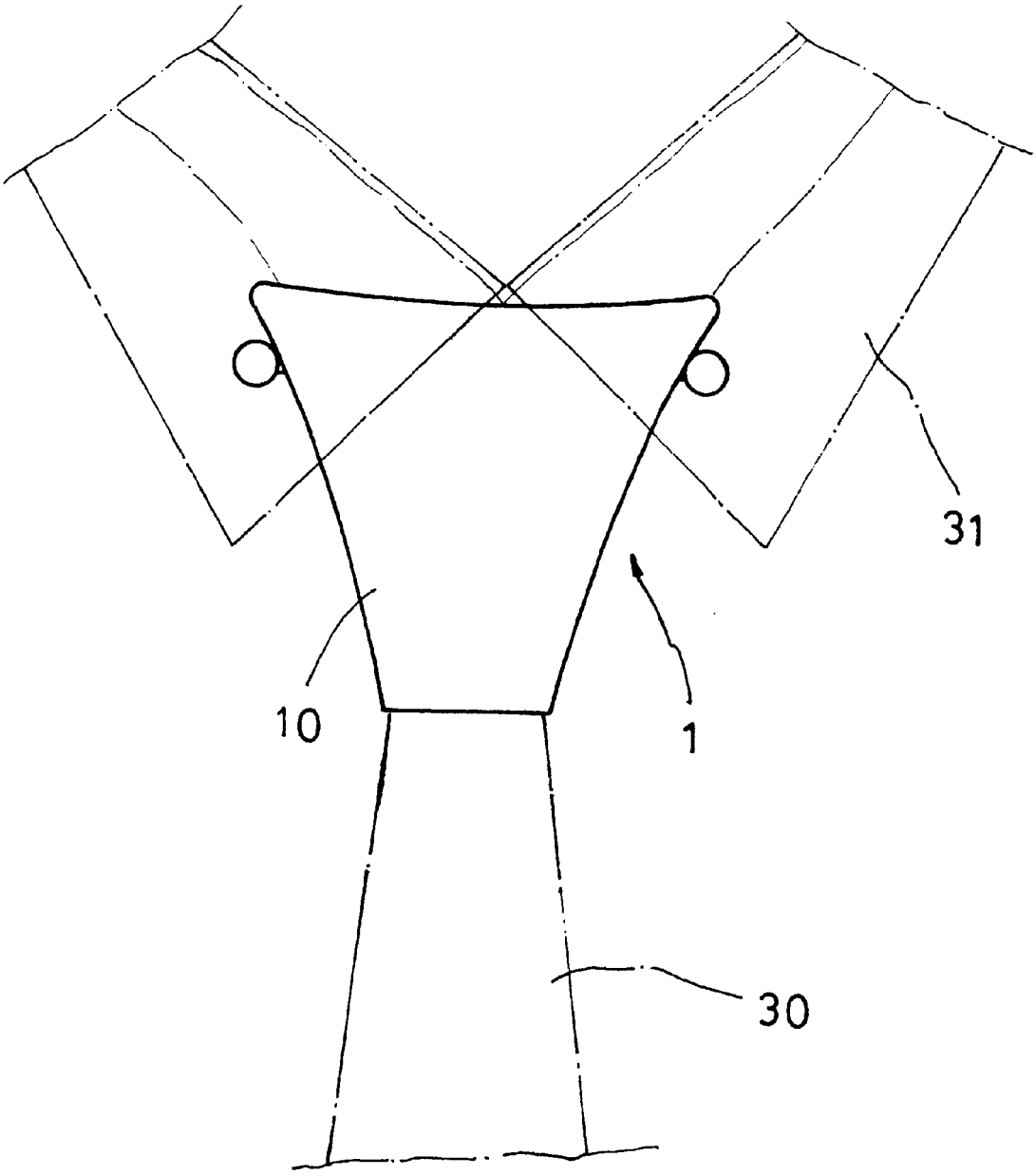
FIG. 8 shows the use of the necktie-setting clip of FIG. 6 to fix the necktie around a user's neck.

FIG. 6 is an assembled perspective view of a necktie-setting clip 1 according to a second embodiment thereof. The necktie-setting clip 1 of this second embodiment is generally similar to that of the first embodiment, except that it has a pressing member 40 formed from a bent steel wire. The pressing member 40 includes a shaped frame 41 and two laterally outward extended shafts 42, 43. The lateral shafts 42, 43 are rotatably connected two upper rear sides of the front shell 10, so that the shaped frame 41 is up and down turnable about the lateral shafts 42, 43 relative to the front shell 10, as shown in FIG. 7. The front shell 10 of this second embodiment is provided at two lower rear sides with two inward projections 13, so that the shaped frame 41 may be located at an inner side of the two projections 13 to press a necktie 30 extended through the top and the bottom openings 11, 12 against the front shell 10. The two lateral shafts 42, 43 have two outmost ends projected from the front shell 10. These two outmost ends. are covered by the shirt collar 31 and are not visible from outside of the shirt collar 31, as shown in FIG. 8. Alternatively, the outmost ends of the lateral shafts 42, 43 may be concealed in the front shell 10 when the necktie-setting clip 1 is manufactured. The front shell 10 of this second embodiment is provided at two lower rear edges with two inward projections 13, so that the shaped frame 41 of the pressing member 40 could be turned downward to locate at an inner side of the projections 13 to press against the necktie 30 extended behind the front shell 10.

The front shells 10 of both embodiments are provided at two rear edges of the wide and flat top opening 11 with two inward projected stoppers 15. The necktie 30 is stopped by the stoppers 15 from easily moving out of the top opening 11 of the front shells 10.

With the necktie-setting clip 1 of the present invention, a user may easily fix a necktie 30 around the neck to save the complicate winding and knotting procedures while there is a beautiful knot-shaped clip 1 immediately below the shirt collar 31. The necktie 30 is therefore not easily deformed due to the forming of a conventional knot. The front shell 10 of the necktie-setting clip 1 may be provided with decorative holes and/or ornaments, such as jewels, jades, etc.

In brief, the necktie-setting clip of the present invention may be used to replace the conventional tie knot, making the setting of necktie around the neck much more easily than before. The necktie-setting clip of the present invention may also be used as a decoration on the necktie to give the latter changeful and attractive appearance.

What is claimed is:

1. A necktie-setting clip, comprising a front shell and a pressing member; said front shell being an open-backed member substantially in the form of an inverted triangle to define a wide and flat top opening and a narrow and deep bottom opening for a necktie to extend through said top and said bottom openings and locate behind said front shell;

said pressing member being pivotally connected at an end to a rear side of said front shell to be turnable up and down relative to said front shell between a horizontal and a downward vertical position, and said pressing member being able to press said necktie against said front shell when said pressing member is turned to said downward vertical position;

wherein said front shell includes a rearward extended hollow shaft having a transverse slot provided at one side thereof and an elastic member mounted in said hollow shaft to normally elastically push an end of a push member into said transverse slot, and said pressing member being a flat frame or a plate having an end formed into a squared pivot shaft; and said squared pivot shaft of said pressing member being rotatably received in said transverse slot of said front shell and being located at said horizontal position when said push member is pushed by said elastic member against a flat end surface of said squared pivot shaft, or at said downward vertical position when said push member is pushed by said elastic member against a flat bottom surface of said squared pivot shaft.

2. The necktie-setting clip as claimed in claim 1, wherein said front shell is provided at two rear edges of said top opening with two inward projected stoppers.

3. A necktie-setting clip, comprising a front shell and a pressing member; said front shell being an open-backed member substantially in the form of an inverted triangle to define a wide and flat top opening and a narrow and deep bottom opening for a necktie to extend through said top and said bottom openings and locate behind said front shell;

said pressing member being pivotally connected at an end to a rear side of said front shell to be turnable up and down relative to said front shell between a horizontal and a downward vertical position, and said pressing member being able to press said necktie against said front shell when said pressing member is turned to said downward vertical position;

wherein said front shell is provided at two lower rear sides with two inward projections, and said pressing member being a shaped frame having two ends rotatably connected to two upper rear sides of said front shell, so that said pressing member is pivotally turnable up and down about said two ends relative to said front shell between said horizontal and said downward vertical positions, and said pressing member being located at an inner side of said two inward projections when said pressing member is turned to said downward vertical position.

4. The necktie-setting clip as claimed in claim 3, wherein said front shell is provided at two rear edges of said top opening with two inward projected stoppers.

* * * * *